US005320059A

United States Patent [19]

Ikeda

[11] Patent Number: 5,320,059

[45] Date of Patent: Jun. 14, 1994

[54] SEAT ARRANGEMENT FOR WATERCRAFT

[75] Inventor: Keijiro Ikeda, Iwata, Japan

[73] Assignee: Yamaha Hatsudoki Kabushiki Kaisha, Iwata, Japan

[21] Appl. No.: 982,842

[22] Filed: Nov. 30, 1992

[30] Foreign Application Priority Data

Dec. 28, 1991 [JP] Japan ..... 3-359433

[51] Int. Cl.[5] ..... B63B 17/00

[52] U.S. Cl. ..... 114/363; 297/94

[58] Field of Search ..... 114/363, 362, 270; 297/94

[56] References Cited

U.S. PATENT DOCUMENTS

| | | | |
|---|---|---|---|
| 684,747 | 10/1901 | Cole | 297/94 |
| 2,383,178 | 8/1945 | Edwards | 297/94 X |
| 2,775,218 | 12/1956 | Kapusnyk | 114/61 |
| 3,473,176 | 10/1969 | Taylor | 114/363 |
| 3,478,712 | 11/1969 | Fox | 115/12 |
| 3,786,892 | 1/1974 | Horton | 180/99 |
| 3,823,431 | 7/1974 | Miller | 114/361 |
| 3,839,757 | 10/1974 | Grimes | 297/192 |
| 4,893,579 | 1/1990 | Kobayashi | 114/270 X |
| 4,962,717 | 10/1990 | Tsumiyama | 114/114 R |
| 5,136,963 | 8/1992 | Zuzik | 114/363 |

FOREIGN PATENT DOCUMENTS

| | | | |
|---|---|---|---|
| 0055288 | 3/1987 | Japan | 114/363 |

OTHER PUBLICATIONS

Vol. 1, Issue #2, "Hot Water" magazine, Jan. 1990, p. 33 and unnumbered page for product SurfRider.

*Primary Examiner*—Sherman Basinger

*Attorney, Agent, or Firm*—Knobbe, Martens, Olson & Bear

[57] ABSTRACT

A seating arrangement for a small watercraft having an operator's seat and a pair of slightly rearwardly positioned rider's seats with a movable back rest that accommodates the rider seated either in a forward or rearwardly facing position. The area behind the side seats forms a deck area for the rider's feet when facing rearwardly and also so as to accommodate rear entry of the watercraft from a body of water in which the watercraft is operating.

18 Claims, 7 Drawing Sheets

SEAT ARRANGEMENT FOR WATERCRAFT

BACKGROUND OF THE INVENTION

This invention relates to a seat arrangement for watercraft and more particularly to an improved seating arrangement for a small watercraft.

One type of very popular small watercraft is propelled by a jet propulsion unit which is mounted in a tunnel positioned beneath a seat on which the rider sits in a straddle fashion. This type of watercraft is generally designed to accommodate only a single rider or the rider and a passenger seated in tandem fashion. However, the utility of this type of watercraft can be greatly expanded if the watercraft can accommodate more than the rider and a single passenger.

However, because of the nature of the watercraft and its relatively small size, it is also desirable to maintain the seating arrangement so that a number of different passengers can be accommodated without adversely affecting the side to side balance of the watercraft. Also, it is desirable to afford a seating arrangement wherein the passengers may sit more closely adjacent the operator.

It is, therefore a principal object of this invention to provide an improved seating arrangement for a small watercraft.

It is a further object of this invention to provide a seating arrangement for a watercraft that will permit one, two, three or more passengers all to be accommodated in a convenient fashion and without shifting the side to side balance of the watercraft.

With the type of watercraft described, there are instances when it may be desirable to permit the passengers to become seated in a way in which they need not face forwardly. However, when the watercraft is in motion, a forward seating position is desirable. In addition, this type of watercraft is normally designed to be operated by a rider and passengers wearing swimming suits. In order to facilitate entry of the watercraft from the body of water in which the watercraft is operating, the rear deck is generally open through the transom so that it can afford rear entry. However, this rear entry can adversely affect the seating arrangement.

It is, therefore, a still further object of this invention to provide an improved seating arrangement for a small watercraft that accommodates passengers seated in either a forwardly or rearwardly facing position.

It is a further object of this invention to provide a seating arrangement for a small watercraft that will accommodate passengers seated facing forwardly or rearwardly and which also still permits the watercraft to be boarded through the rear from the body of water in which the watercraft is operating.

SUMMARY OF THE INVENTION

A first feature of this invention is adapted to be embodied in a seat arrangement for a small watercraft having a hull defining a rider's area. First seat means are disposed generally along a longitudinal center line of the hull and are adapted to seat an operator. Watercraft control means are positioned in proximity to the first seat means for control of the watercraft by an operator seated upon the first seat means. Second seat means are disposed rearwardly of the first seat means for accommodating a pair of passengers on opposite sides of the operator for maintaining side to side balance. At least one of the seat means has a portion supported for movement between two different positions for affording two different seating postures.

Another feature of the invention is also adapted to be embodied in a seat arrangement for a small watercraft defining a rider's area. In accordance with this feature of the invention, the rider's area extends at least in part along the rear edge of the hull. A seat cushion extends transversely across the rear portion of the rider's area and a first foot area is defined by the hull forwardly of the seat cushion for accommodating the legs of a rider seated in a forwardly facing direction on the seat cushion. A second foot area is defined by the hull to the rear of the seat cushion and open through the rear of the hull for accommodating a rider seated on the seat cushion and facing rearwardly and for permitting entry onto the seat cushion through the rear of the hull.

DETAILED DESCRIPTION OF THE PREFERRED EMBODIMENTS OF THE INVENTION

Figure 1:
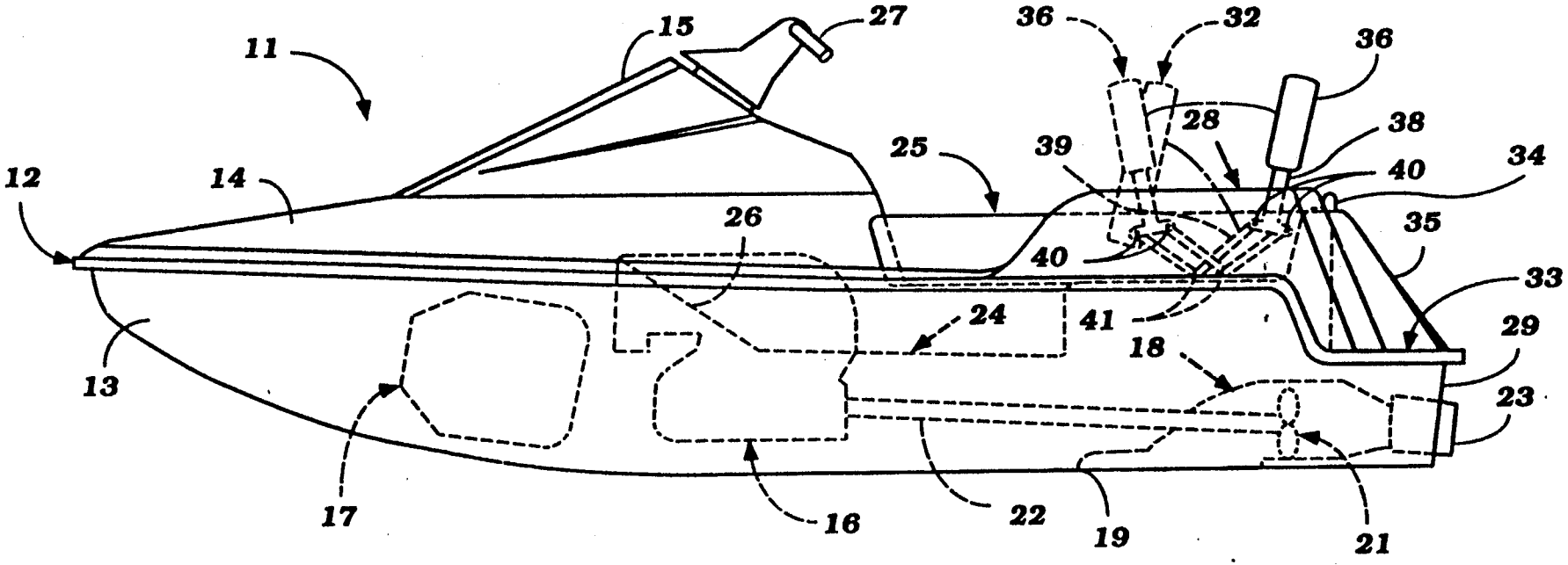
FIG. 1 is a side-elevational view of a small watercraft constructed in accordance with an embodiment of the invention and showing the seats in one position in solid line views and in another position in phantom line views.

Referring now in detail to the drawings and initially primarily to FIG. 1, a small watercraft having a seating arrangement constructed in accordance with an embodiment of the invention is identified generally by the reference numeral 11. The small watercraft 11 is comprised of a hull, indicated generally by the reference numeral 12, and being comprised of a lower hull portion 13 and an upper deck portion 14. The hull portion 13 and deck portion 14 may be made from a suitable material such as a molded fiberglass reinforced resinous plastic and the portions 13 and 14 are affixed to each other in a suitable manner.

A raised bridge 15 is formed generally centrally of the hull 12 and overlies an engine compartment in which an internal combustion engine 16 of any known type may be positioned. The engine 16 is accessible through a removable hatch cover which may form a portion of the bridge 15. In addition, various engine auxiliaries such as a fuel tank 17 may be provided in this forward area beneath the bridge 15.

Rearwardly of the engine 16, the hull portion 13 is formed with a tunnel in which a jet propulsion unit, indicated generally by the reference numeral 18 is positioned. The jet propulsion unit 18 has a downwardly facing water inlet opening 19 that opens through the bottom of the hull portion 13 and through which water may be drawn under the action of an impeller 21. The impeller 21 is affixed to an impeller shaft 22 which is driven by the output shaft of the engine 16 in a known manner. This water is then discharged through a steering nozzle 23 that is supported for pivotal movement about a vertically extending steering axis for controlling the direction of the watercraft 11. The construction as thus far described may be considered to be conventional and, for that reason, further details of the construction of the hull 12 and its manner of propulsion are not believed to be necessary to understand the construction and operation of the invention, which will now be described by reference to the remaining figures.

Figure 2:
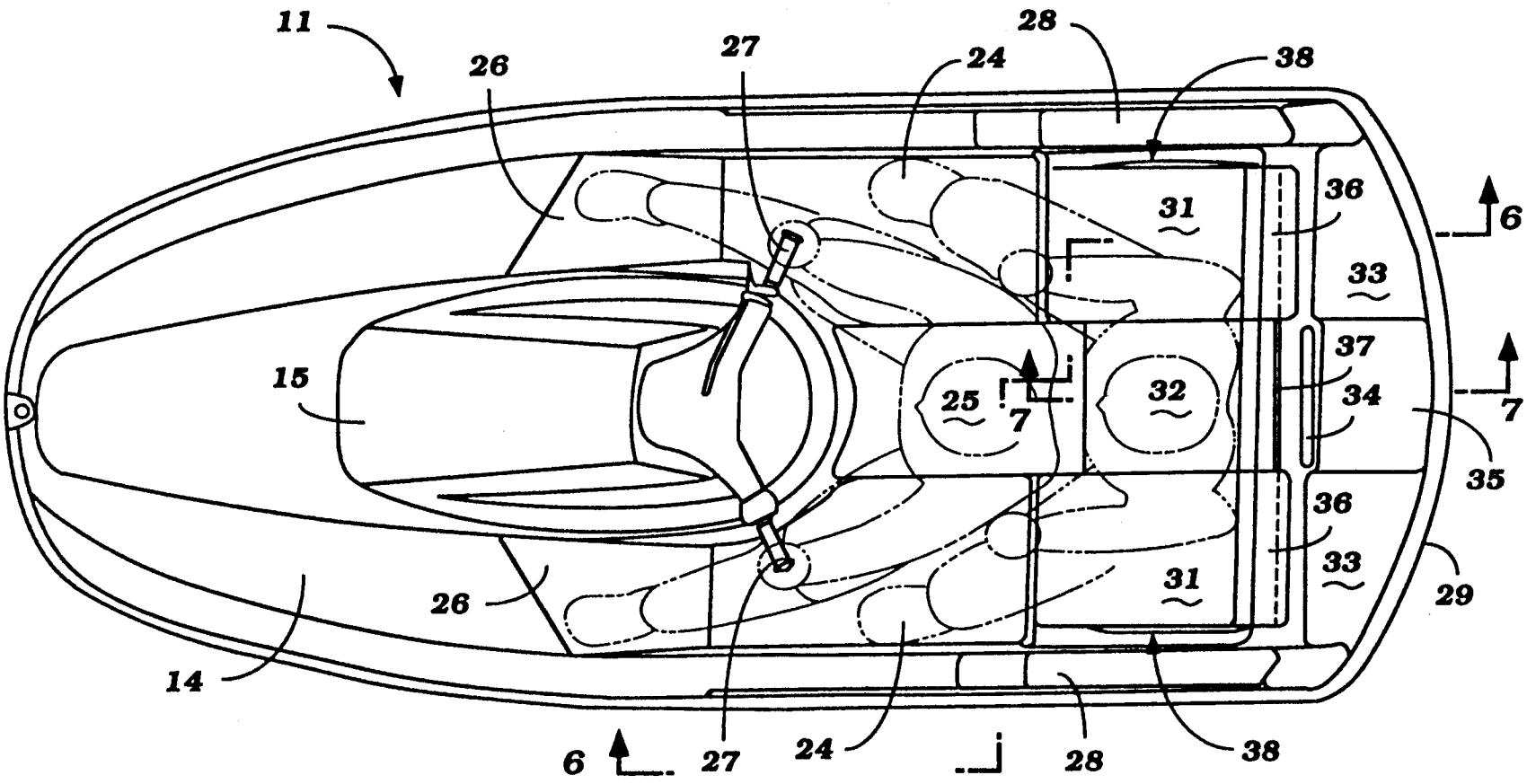
FIG. 2 is a top plan view of the watercraft showing the operator and a single passenger seated in tandem fashion.
Figure 7:
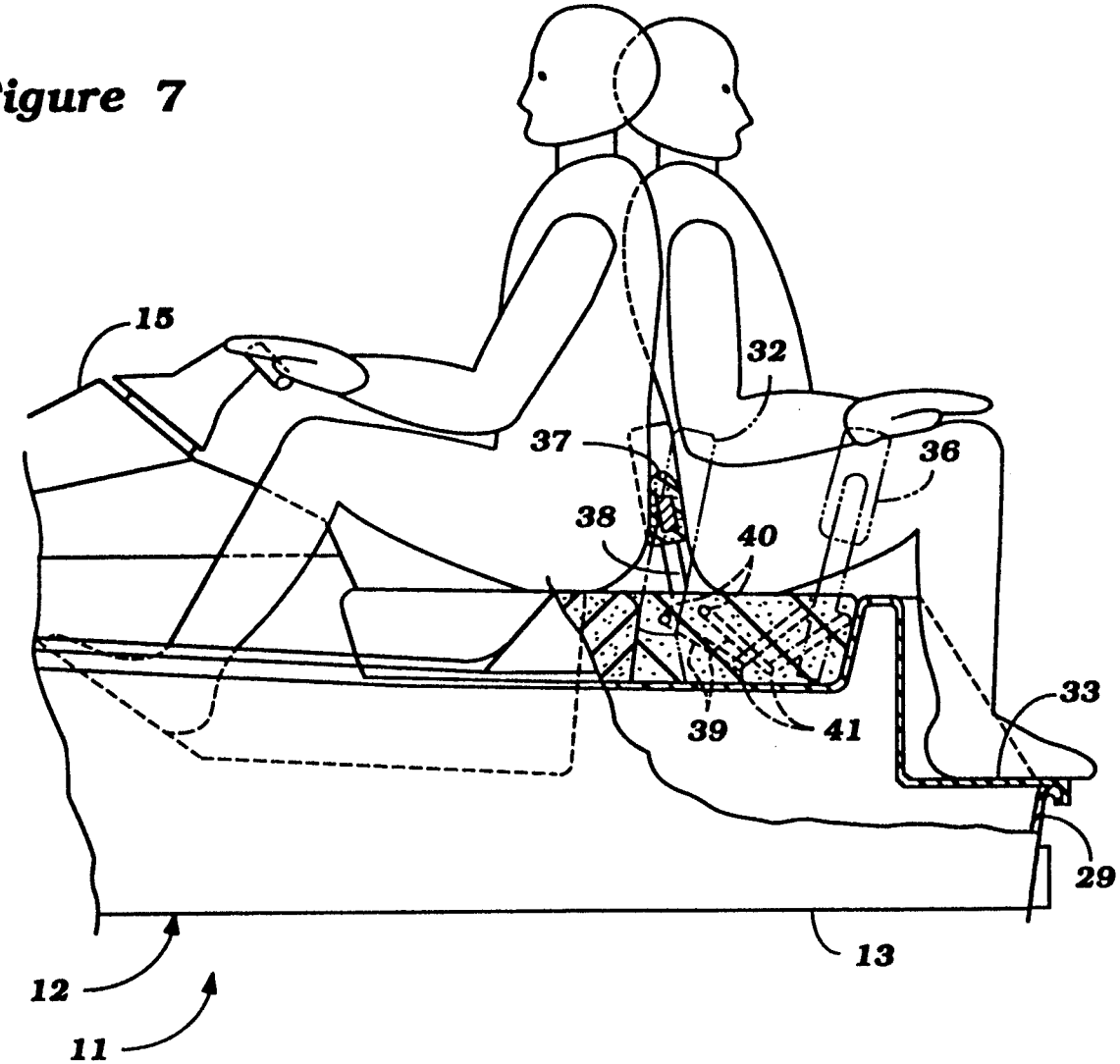
FIG. 7 is a cross-sectional view taken along the line 7—7 of FIG. 2 and shows another possible seating arrangement.

A rider's area is formed to the rear of the bridge 15 and this rider's area is comprised of a first, forward recessed floor portion 24 with a rider's or operator's seat 25 being positioned centrally thereof so that a rider may sit on the seat 25 in a straddle fashion with his feet extending along the foot area 24 and resting upon upwardly inclined forward portions 26 thereof as best shown in FIGS. 2 and 7.

A handlebar assembly 27 is mounted on the bridge 15 and is connected to the steering nozzle 23 in a known manner so as to permit operator control of the watercraft. In addition, one of the handlebar assemblies 27 may be rotatable to operate a throttle control mechanism connected to the throttle of the engine 16 for control of the rate of speed of travel.

There are a pair of raised gunnels 28 that extend along opposite sides of the rider's area to the rear of the foot areas 24 and which terminate at the transom 29 of the watercraft.

Slightly to the rear and to sides of the rider or operator's seat 25 there are provided a pair of side by side passenger seats 31. The seats 31, as will become apparent, are designed so as to accommodate individual riders seated in either a forwardly facing direction or a rearwardly facing direction. In addition, an intermediate seat 32 is provided to the rear of the rider's seat 25. This rear seat 32 is adapted to accommodate a passenger seated in tandem fashion behind the operator, as shown in phantom in FIG. 2, so that two riders may be present on the watercraft without adversely affecting the side-to-side balance. In addition, the seat 32 is pivotal relative to the seat 25 between a normal lower position as shown in solid line views in all of the Figures and a raised view as shown in phantom in FIGS. 1 and 7 wherein the seat portion 32 may form a back rest for the single rider/operator.

The type of watercraft illustrated is designed primarily for very sporting purposes and hence is normally operated with the rider/operator and passengers wearing swimming suits. Frequently, they may enter the watercraft 11 from the body of water in which the watercraft is operating and for this purpose there are provided a pair of combined rear deck and foot areas 33 which are positioned to the rear of the side seats 31 and which open through the rear of the transom as clearly shown in the figures so that riders may easily enter the watercraft from the body of water in which it is operating. A grab handle 34 may be provided at the top of a raised central area 35 which separates the foot areas 33 so as to assist in this rear entry.

Figure 3:
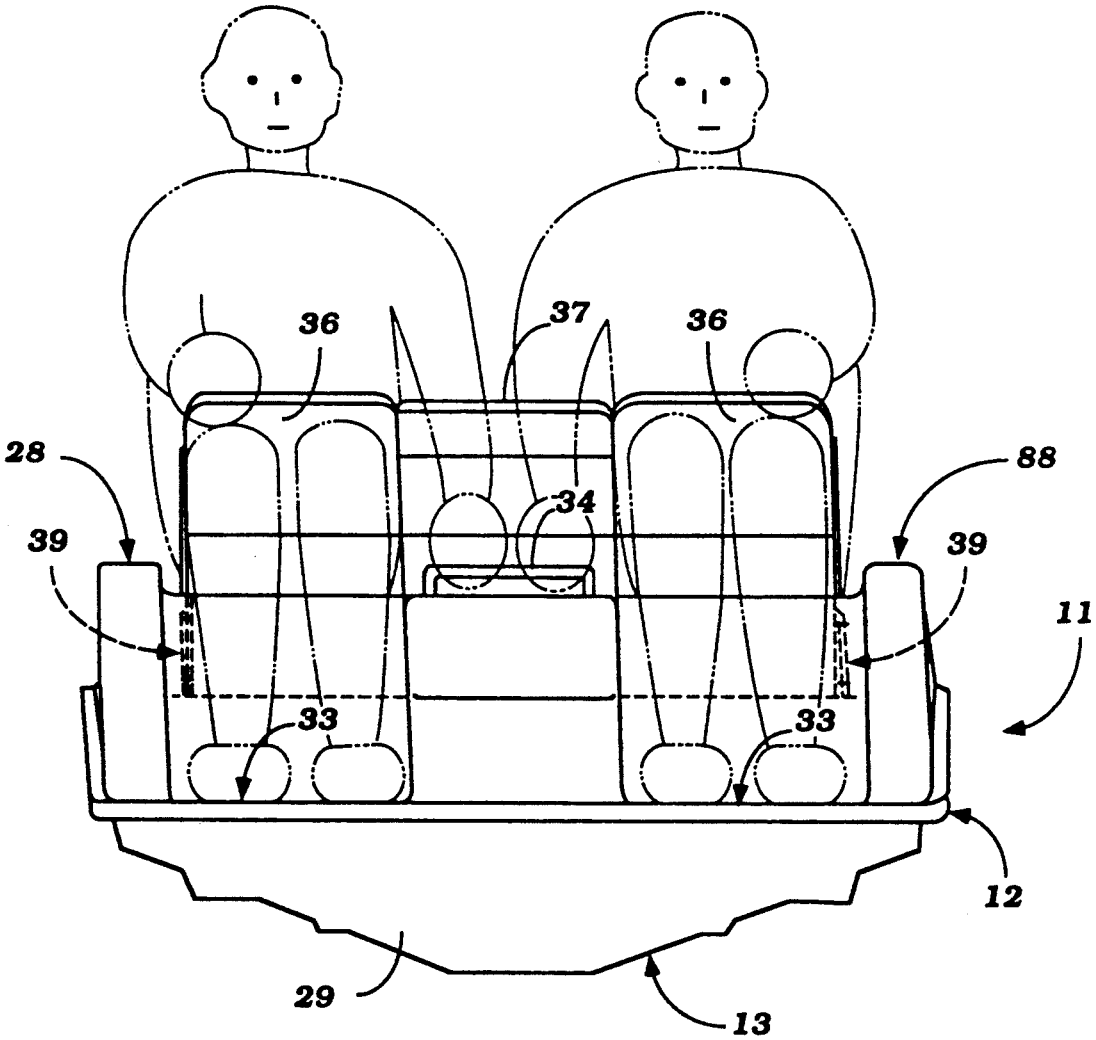
FIG. 3 is a rear elevational view of the watercraft showing two passengers seated in a rearwardly facing direction.
Figure 4:
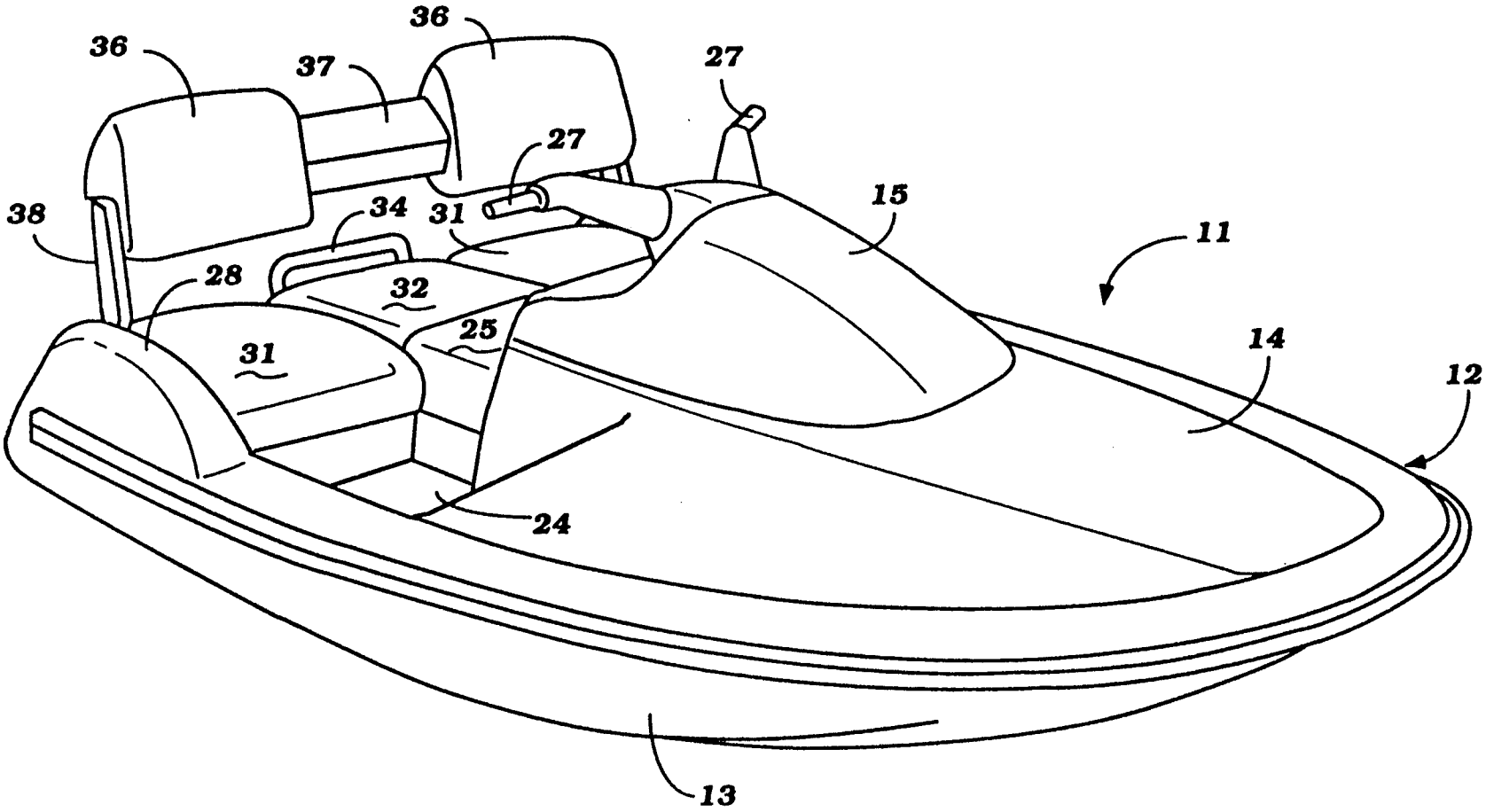
FIG. 4 is a front side perspective view of the watercraft.
Figure 5:
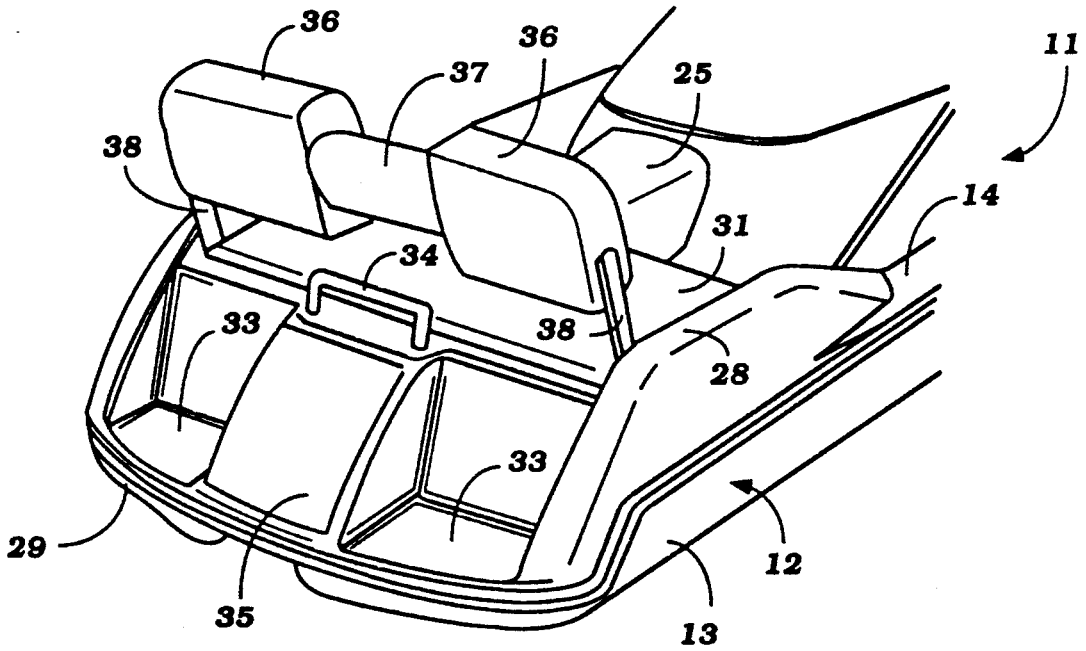
FIG. 5 is a partial perspective rear side view of the watercraft.
Figure 6:
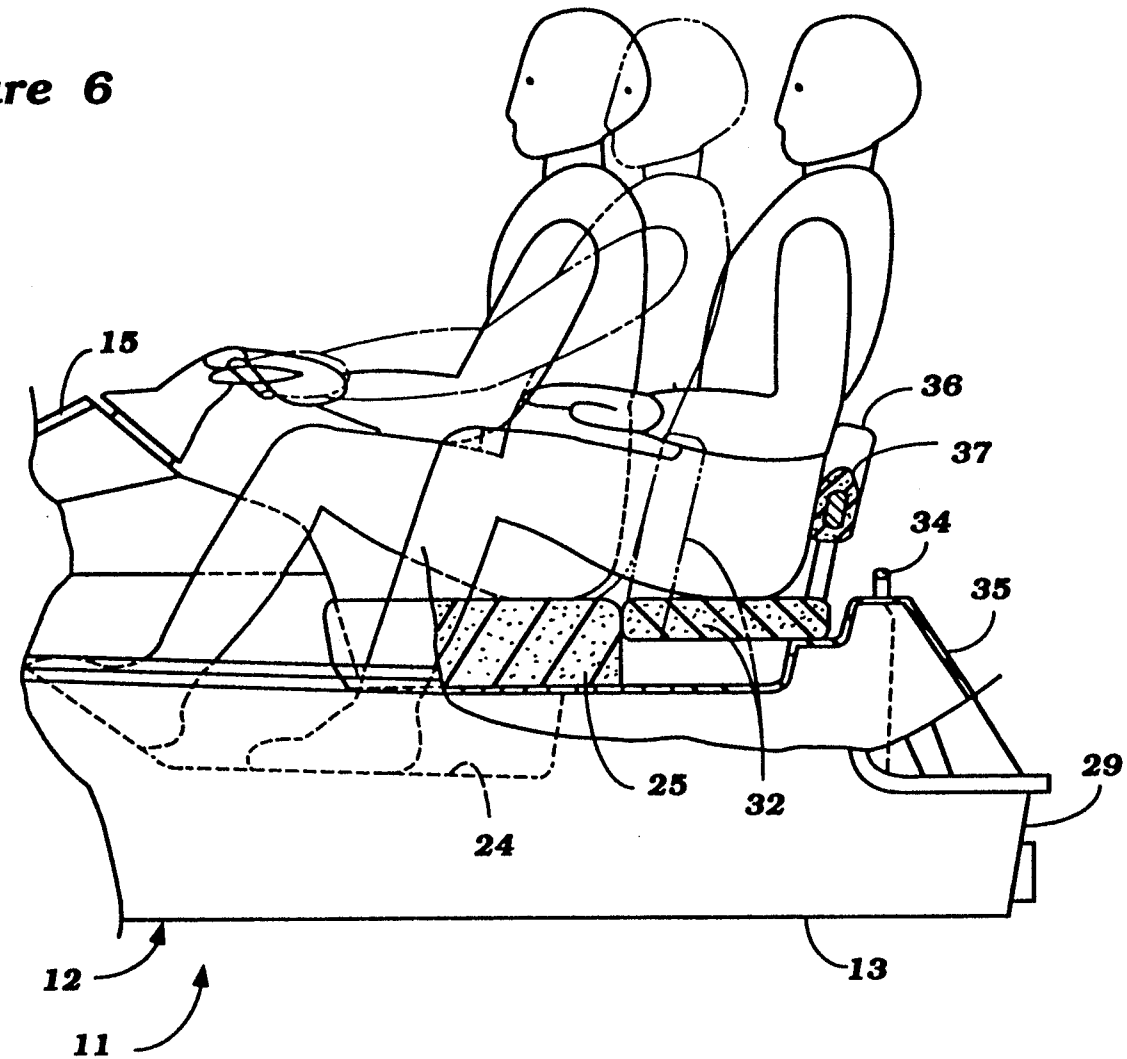
FIG. 6 is a partial cross-sectional view taken along the line 6—6 of FIG. 2 and shows one possible seating arrangement.

A seat back assembly which accommodates the aforenoted dual purpose seating arrangement for the side seats 31 is provided which is comprised of seat back cushions 36 formed coextensively with the seats 31 and an interconnecting crossbar 37. This assemblage comprised of the seat backs 36 and crossbar 37 is supported by means of a pair of side struts 38. The side struts 38 are, in turn, supported by a linkage assembly, indicated generally by the reference numeral 39, which is comprised of a pair of links having lower pivotal connections 41 to the hull and upper pivotal connections 40 to the struts 38 to permit the seat backs to be swung between a forwardly facing position as shown in solid lines in FIGS. 1, 2, 4 and 5 wherein the riders may sit on the seats 31 with their feet in the foot areas 24 on opposite sides of the rider/operator and a rearwardly facing position as shown in solid lines in FIG. 3 and in phantom lines in FIG. 1 wherein the passengers may sit on the seats 31 with their feet in the rear deck area 33 while still engaging the seat backs 36.

When the passengers are seated facing rearwardly as shown in FIG. 7, the crossbar 37 will provide a back rest and limit to how far the rider/operator may lean back. As may be seen in this figure, even if the seat portion 32 is folded up to form a seat back, the rider/operator cannot lean back this far and thus will not interfere with the rearwardly facing passengers.

However, as seen in FIG. 7, when the passengers are seated in a forwardly facing position, the rider/operator may either sit erect or may place the seat portion 32 in an upward position so as to lean back.

The described construction is obviously effective in providing a good seating posture and will permit the operation of the watercraft with one, two or three occupants and having good balance under all conditions. In addition, the seating arrangement is such that the passengers may sit either forwardly or rearwardly facing and the watercraft can be conveniently entered through the rear from the body of water in which it is operating. Of course, the foregoing description is that of a preferred embodiment of the invention and various changes and modifications may be made without departing from the spirit and scope of the invention, as defined by the appended claims.

I claim:

1. A seat arrangement for a small watercraft having a hull defining a rider's area, first seat means disposed generally along the longitudinal center line of said hull and adapted to seat an operator, watercraft control means in proximity to said first seat means for control of said watercraft by an operator seated upon said first seat means, and second seat means disposed rearwardly of said first seat means and comprised of a pair of spaced apart seats for accommodating a pair of riders on opposite sides of the operator for maintaining side by side balance, said first seat means having a foldable back rest portion movable between a raised position offering seat back for an operator seated on said first seat means and a lowered position at least in part between the seats of said second seat means for accommodating a passenger seated in tandem fashion with the operator.

2. A seat arrangement for a small watercraft having a hull defining a rider's area, first seat means disposed generally along the longitudinal center line of said hull and adapted to seat an operator, watercraft control means in proximity to said first seat means for control of said watercraft by an operator seated upon said first seat means, and second seat means disposed rearwardly of said first seat means for accommodating a pair of riders on opposite sides of the operator for maintaining side by side balance, said second seat means having a moveable back portion moveable between first and second positions for accommodating the pair of riders in either a forwardly facing position when in its first position or a rearwardly facing position when said back portion is in said second position.

3. A seat arrangement as set forth in claim 2 wherein the rider's area defines a deck to the rear of the second seat means in which the riders may place their feet when seated in a rearwardly facing position.

4. A seat arrangement as set forth in claim 3 wherein the first seat means has a foldable back rest portion movable between a raised position offering a seat back for an operator seated on said first seat means and a lowered position for accommodating a passenger seated in tandem fashion with the operator.

5. A seat arrangement as set forth in claim 4 wherein the movable back portion comprises a pair of spaced apart back portions each cooperating with a respective portion of the second seat means and interconnected by a crossbar.

6. A seat arrangement as set forth in claim 5 wherein the crossbar provides a back for the operator when seated on the first seat means and when the movable back portion is in its second position.

7. A seat arrangement as set forth in claim 2 wherein the movable back portion comprises a pair of spaced apart back portions each cooperating with a respective portion of the second seat means and interconnected by a crossbar.

8. A arrangement as set forth in claim 7 wherein the crossbar provides a back for the operator when seated on the first seat means and when the movable back portion is in its second position.

9. A seat arrangement as set forth in claim 2 wherein the hull defines a tunnel at the rear thereof containing a jet propulsion unit, said first seat means being disposed at least in part directly above said tunnel.

10. A seat arrangement as set forth in claim 9 wherein the rider's area defines a deck to the rear of the second seat means in which the riders may place their feet when seated in a rearwardly facing position.

11. A seat arrangement as set forth in claim 10 wherein the first seat means has a foldable back rest portion movable between a raised position offering a seat back for an operator seated on said first seat means and a lowered position for accommodating a passenger seated in tandem fashion with the operator.

12. A seat arrangement as set forth in claim 11 wherein the movable back portion comprises a pair of spaced apart back portions each cooperating with a respective portion of the second seat means and interconnected by a crossbar.

13. A seat arrangement as set forth in claim 9 wherein the movable back comprises a pair of spaced apart back portions each cooperating with a respective portion of the second seat means and interconnected by a crossbar.

14. A seat arrangement as set forth in claim 13 wherein the crossbar provides a back for the operator when seated on the first seat means and when the movable back portion is in its second position.

15. A seat arrangement for a small watercraft having a hull defining a rider's area extending at least in part along the rear edge of said hull, a pair of transversely spaced apart seat cushions at a rear portion of said rider's area, a first foot area defined by said hull forwardly of said seat cushions for accommodating the legs of the rider seated in a forward facing direction on said seat cushions, a second foot area defined by said hull to the rear of said seat cushions and open through the rear of said hull for accommodating riders seated on said seat cushions and facing rearwardly and for entry on to said cushions through the rear of said hull, and a rider's seat disposed between and forwardly of said spaced apart seat cushions.

16. A seat arrangement for a small watercraft having a hull defining a rider's area extending at least in part along the rear edge of said hull, and seat cushion extending transversely across a rear portion of said rider's area, a first foot area defined by said hull forwardly of said seat cushion for accommodating the legs of the rider seated in a forward facing direction on said seat cushion, and a second foot area defined by said hull to the rear of said seat cushion and open through the rear of said hull for accommodating riders seated on said seat cushion and facing rearwardly and for entry on to said cushion through the rear of said hull, and a movably supported back rest disposed relative to said seat cushion for affording a back rest for a rider when said rider is forwardly or rearwardly facing.

17. A seat arrangement as set forth in claim 16 wherein there are a pair of spaced apart seat cushions and further including a rider's seat disposed between and forwardly of said spaced apart seat cushions.

18. A seat arrangement as set forth in claim 17 wherein the seat backs are interconnected by a bar which provides a seat back for the operator on the rider's seat when the bar is in a position to accommodate the rider seated in a rearwardly facing position.

* * * * *